US006802443B2

(12) United States Patent
Lu

(10) Patent No.: US 6,802,443 B2
(45) Date of Patent: Oct. 12, 2004

(54) HAMMER-TYPE STAPLER WITH CARTRIDGE

(75) Inventor: Chun-Ming Lu, No. 7, Alley 4, Lane 71, Lin Sen Rd., Tao Yuan City (TW)

(73) Assignees: Chun-Ming Lu, Tao Yuan (TW); Chun-Chih Chen, Taipei (TW)

( * ) Notice: Subject to any disclaimer, the term of this patent is extended or adjusted under 35 U.S.C. 154(b) by 0 days.

(21) Appl. No.: 10/369,703

(22) Filed: Feb. 21, 2003

(65) Prior Publication Data

US 2004/0169059 A1 Sep. 2, 2004

(51) Int. Cl.[7] ..... B25C 1/06

(52) U.S. Cl. ..... 227/109; 227/120; 227/133; 227/147

(58) Field of Search ..... 227/109, 120, 227/133, 134, 139, 147, 119, 132, 136

(56) References Cited

U.S. PATENT DOCUMENTS 1,890,694 A * 12/1932 Polzer ..... 227/133
1,970,101 A * 8/1934 Maynard ..... 227/118
2,193,143 A * 3/1940 Rapien ..... 227/133
2,332,257 A * 10/1943 Polzer ..... 227/109
2,399,374 A * 4/1946 Morberg ..... 227/133
2,537,601 A * 1/1951 Peterson ..... 227/133
2,896,210 A * 7/1959 Rubin ..... 227/133
6,012,623 A * 1/2000 Fealey ..... 227/134
6,179,194 B1 * 1/2001 Morton ..... 227/133

* cited by examiner

*Primary Examiner*—Scott A. Smith
(74) *Attorney, Agent, or Firm*—Rosenberg, Klein & Lee

(57) ABSTRACT

A hammer-type stapler with cartridge is a tool using in building working for driving staples into a working object, comprising a casing having a hollow hammer casing on the front portion of the casing for containing a driving unit. The driving unit moves vertically by inertia force and having a driving element for driving staples, and an elastic element for recoiling the driving unit. A replaceable cartridge is installed in the casing and adjacent to the driving element having two identical, upper and lower staple containers. A pushing device is slidably mounted in the casing for holding the cartridge and pushing staples. The cartridge can load different size staples.

17 Claims, 14 Drawing Sheets

HAMMER-TYPE STAPLER WITH CARTRIDGE

BACKGROUND OF THE INVENTION

1. Field of the Invention

The present invention relates to a hammer-type stapler with cartridge and more particularly pertains to manually operated impact staplers in building, for string staples into working piece, for example, thin board, blanket, or asphalt felt on the roof, and fix it.

2. Description of the Prior Art

The use of stapler is known in building. Hammer-type stapler is usually needed in the building site without electric power, like out door.

Two kinds of hammer-type staplers are as follow. Referring to FIG. 1 is a perspective view of the first kind of hammer-typo stapler of prior art. By holding the handle 1001 and wielding the stapler to make the driving element guiding device 2001 to strike a target piece. Because of the force of inertia, the driving element 1101 will move in curving line with an axle center of the pin 1002 (referring to FIG. 2). The driving element 1101 will strike the first staple 2002 into the target piece.

However, the driving element 1101 does not strike the staples in a vertical line. It will increase the opportunity of jam (means the staple was jammed in the driving element guiding device 2001) because of the side direction force. To clean a jam, first, remove the hook set 3002 from the end of the casing 100. Second take out the press spring set 300, then pull the pin 1002. Lastly, take out the staple containing set 200 from the front portion of the casing 100. After removing the jammed staple, install all the elements in reverse order. It takes so many steps and is very complicated. When installing the elements in reverse order, it is easy to miss an element, especially when working outdoor.

Referring to FIG. 3 is the second kind of hammer-type stapler of prior art. By holding the handle 400 and wielding the ahead striking hammer set 500 to strike a target piece. Because of the reacting force, the trip lever 600 which projected downward will move upward along the guiding groove 6001 of the trip lever 600 and push a control pin 5001. Referring to FIG. 4–5, is a perspective view of the striking hammer set of prior art. Because the control pin 5001 is fixed on the stapler pusher 5003, by applying the principle of lever, the control pin 5001, then, makes the stapler pusher 5003 move counterclockwise With a fulcrum of a rivet 5002. A tip 5004 formed at the front of the stapler pusher 5003 push a driving element 700 downward in a curving way, then the driving element 700 strikes a staple 701 and into a target piece. An elastic plate 5005 push the stapler pusher 5003 to the original position.

The second kind of stapler doesn't move vertically either. On the other hand, if a jam should occur, referring to FIGS. 6A–6D is the perspective view of the jam cleaning procedure of the second kind of prior art. First, as shown in the FIG. 6A, lift the handle lip 4001, then, pull the staple feeder spring 4002 and pusher 4003 to the back of the tool and disengage, and remove all unused staples to avoid the staples from shooting out when cleaning the jam. The second step, as shown in the FIG. 6B, disassembles the jaw release spring 800. Then, as shown in the FIG. 6C, the right hand holds the control pin 5001; the left hand simultaneously holds the trip lever 600 and takes apart the control pin 5001. Finally, as shown in the FIG. 6D, slip off the front jaw 900 by pivoting it down and off from the back end. Then remove any jammed staples and carefully clean the tool.

This kind of stapler has the hidden danger of staple shooting out when cleaning the jam and on the other hand, it involves several jam cleaning procedure. In addition, the elements were exposed and had much seams, so sand may be deposited at its seams result in its breakdown.

In conclusion, the disadvantages of the prior staplers are as followed:

1. The movement of the driving element of the prior staplers is in a curving way and not in a vertical way. It produces a lateral force besides the vertical force, so that it easily leads to a staple jamming.
2. When cleaning the jammed staples of the prior staplers, the cleaning procedure involves much time, reducing the working efficiency.
3. The prior staplers include many metal elements and many connecting procedures between those elements. Much time and high cost are needed for its production.
4. The prior staplers were limited lo use staple of specific size or type, it could not use different size of staples. Due to different factory brand, those staples may have a 5 mm difference in width, causing the staples to jam, even damaging to the tool and seriously injury to the user or others in the work area with the staple fragments.

SUMMARY OF THE INVENTION

The general purpose of the present invention is to provide a new hammer-type stapler with cartridge, which has a device driving the staples vertically to guide the striking force on the staples efficiently without any other non-vertical force for reducing the opportunity of jam.

Another purpose of the present invention is to provide a design of replaceable cartridges. Such replaceable cartridge can simplify the steps of loading staples and cleaning jammed staples, also, it is safe and quickly.

The present invention was made of a lot of plastic material and simplifies the steps of manufacturing to enable the assembly line to be fast and to drop the cost of manufacturing. Moreover, it is a close module that will not be deposited with sand, prolonging its useful life.

Even better, the present invention can use the same stapler to load various wide staples by using another embodiment of a cartridge for various wide staples, which could load various wide staples.

In view of the foregoing disadvantages inherent in the known types of staplers now present in the prior art, another hammer tool is needed for staples which have been driven improperly, the present invention provides one more function as a hammer mounting a metal hammering plate on the top of the stapler.

To attain this, the present invention, a new hammer-type stapler with cartridge for driving a staple into a target piece, generally comprises a casing having a front portion and a handle connected with a distal end of the front portion, a hollow hammer casing extended from an opposing end of the front portion a driving unit vertically mounted in the hammer casing for driving the staple with a vertical action, a replaceable cartridge installed in the front portion, a pushing device slidably mounted in the handle for pushing the staple in the cartridge to a driven position, and a metal hammering plate mounted on a top of the hammer casing whereby the stapler with a function of being a hammer.

These together with other objects of the invention, along with the various features of novelty which characterize the invention, are pointed out with particularity in the claims annexed to and forming a part of this disclosure. For a better understanding of the invention, its operating advantages and the specific objects attained by it uses, reference should be made to the accompanying drawing and descriptive matter in which there are illustrated preferred embodiments of the invention.

BRIEF DESCRIPTION OF THE DRAWINGS

The invention will be better understood and objects other than those set forth above will-become apparent when consideration: is given to the following detailed description thereof. Such description makes reference to the annexed drawings wherein.

DESCRIPTION OF THE PREFERRED EMBODIMENT

Figure 1:
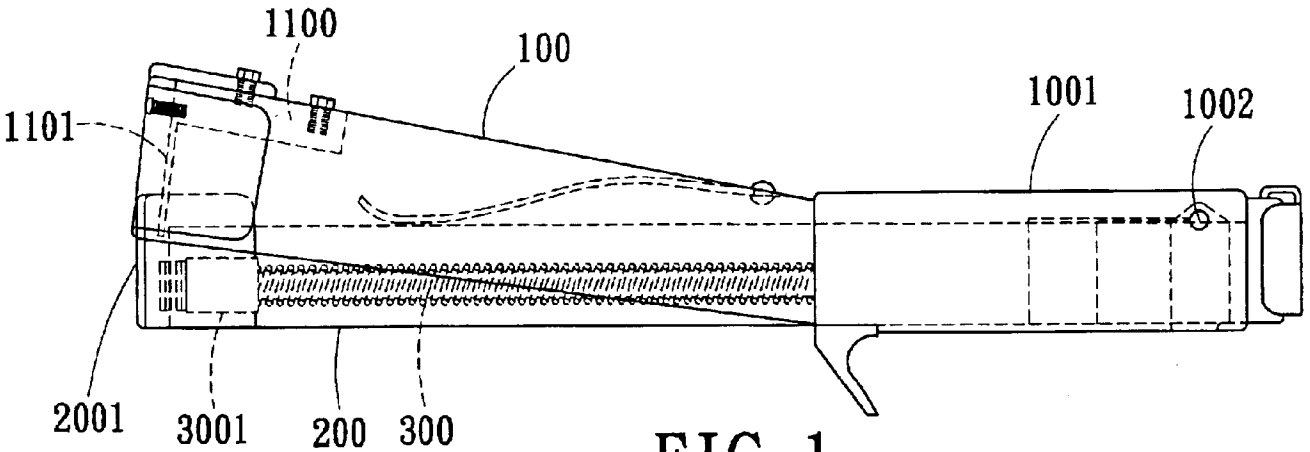
FIG. 1 PRIOR ART
FIG. 1 is a perspective view of the first kind of hammer-type staplers of prior art.
Figure 2:
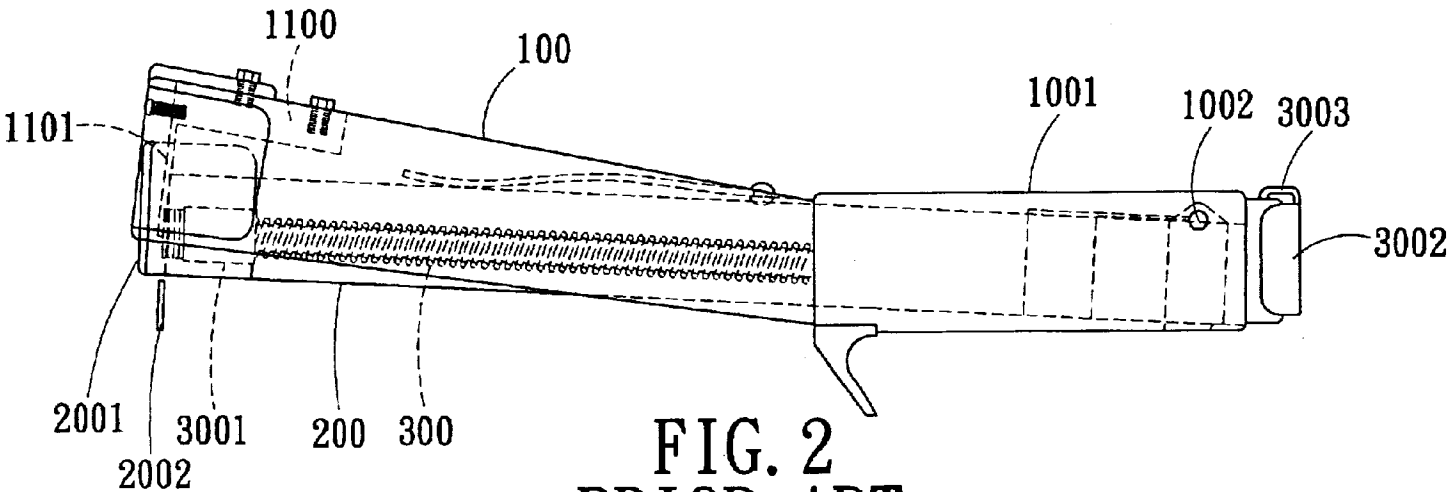
FIG. 2 PRIOR ART
FIG. 2 is a perspective view of the first kind of prior hammer-type staplers when striking a staple.
Figure 3:
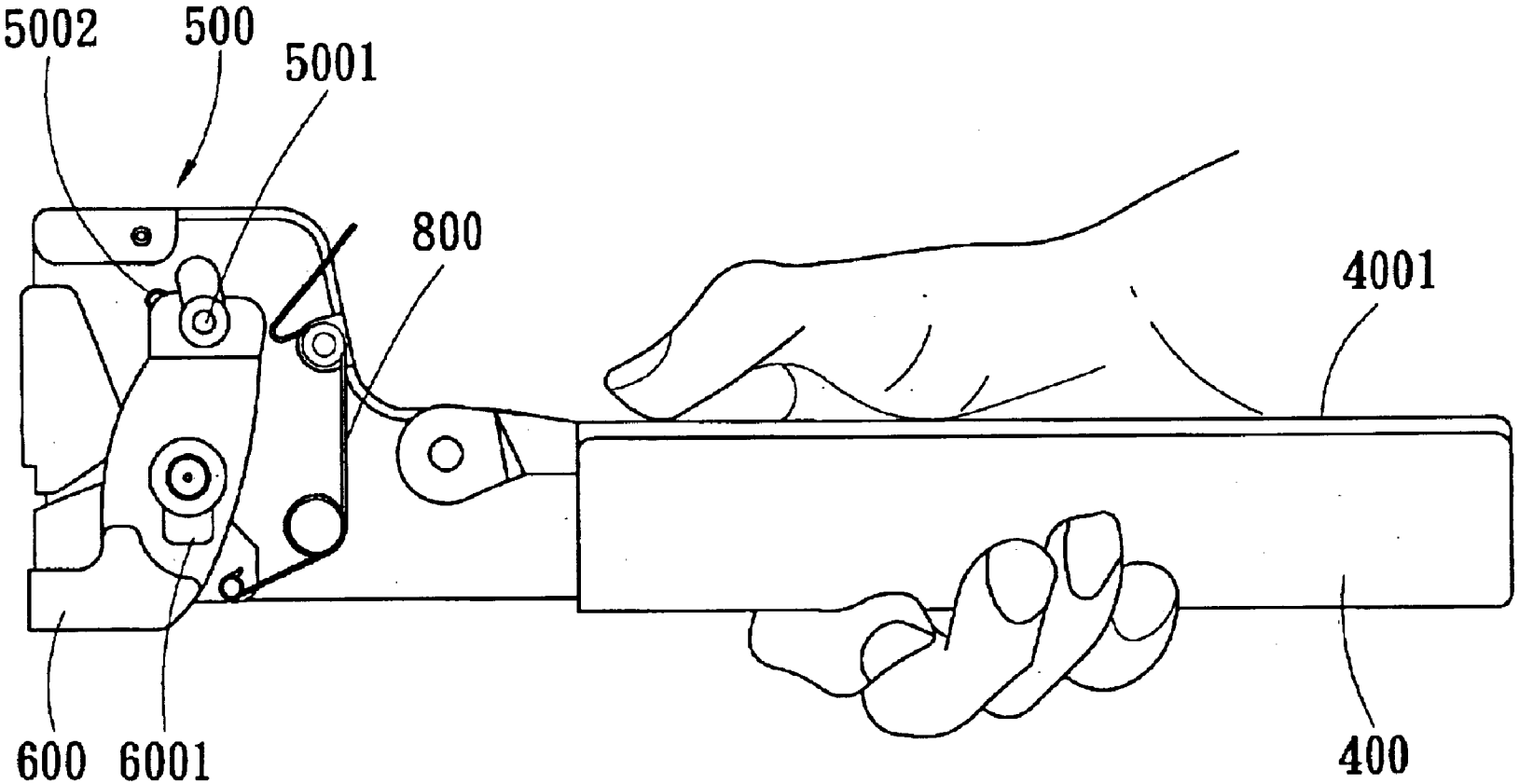
FIG. 3 PRIOR ART
FIG. 3 is a schematic perspective view of the second kind of hammer-type staplers of prior art.
Figure 5:
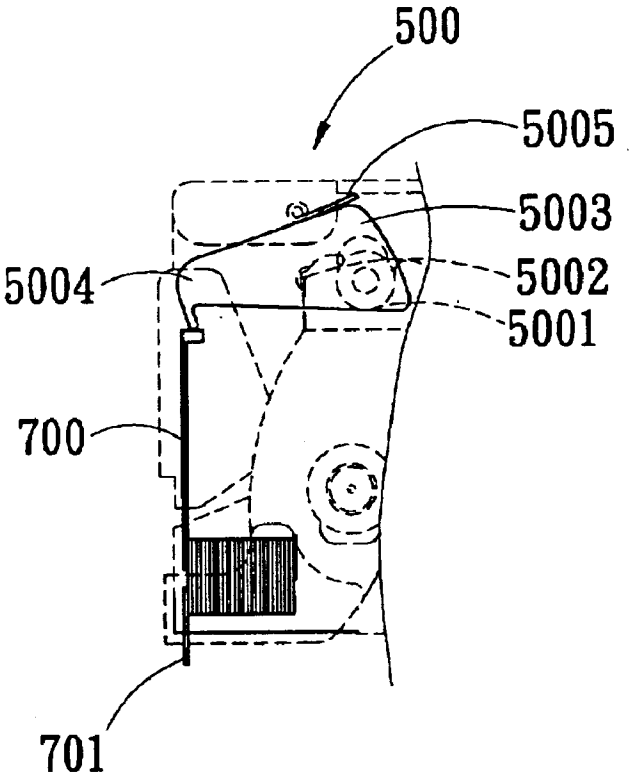
FIG. 5 PRIOR ART
FIG. 5 is a perspective view of the striking hammer set of the second kind of prior art.
Figure 4:
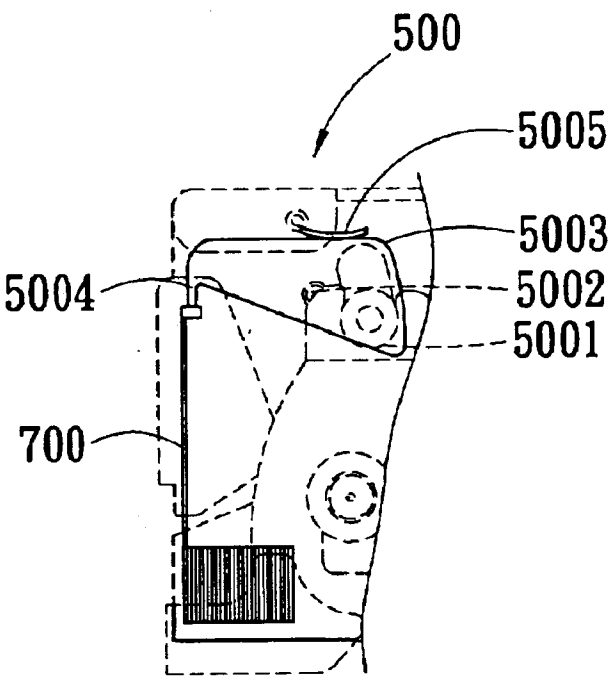
FIG. 4 PRIOR ART
FIG. 4 is a perspective view of the striking hammer set of the second kind of prior art.
Figure 6A:
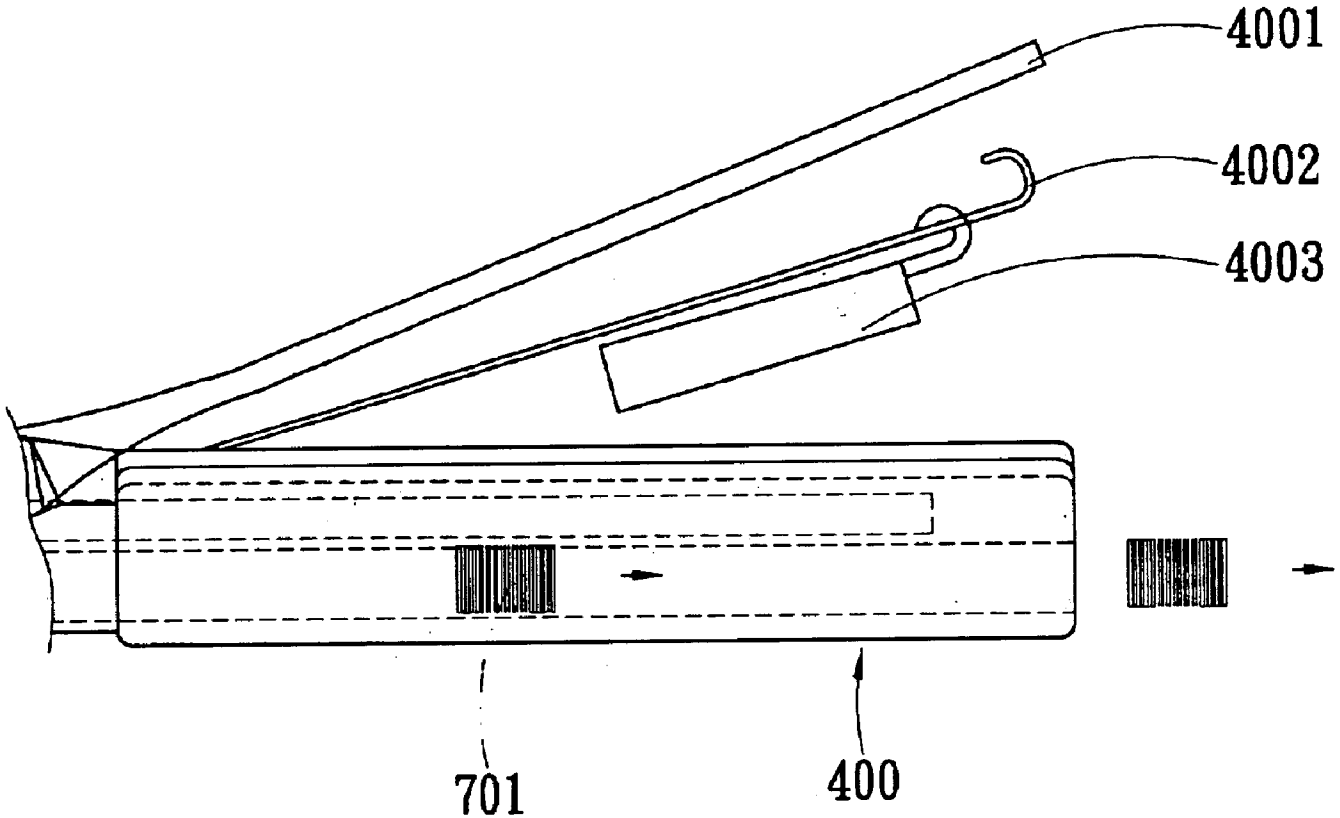
FIG. 6A PRIOR ART
FIG. 6A to 6D is a perspective view of the jam cleaning procedure view of the second kind of prior art.
Figure 6B:
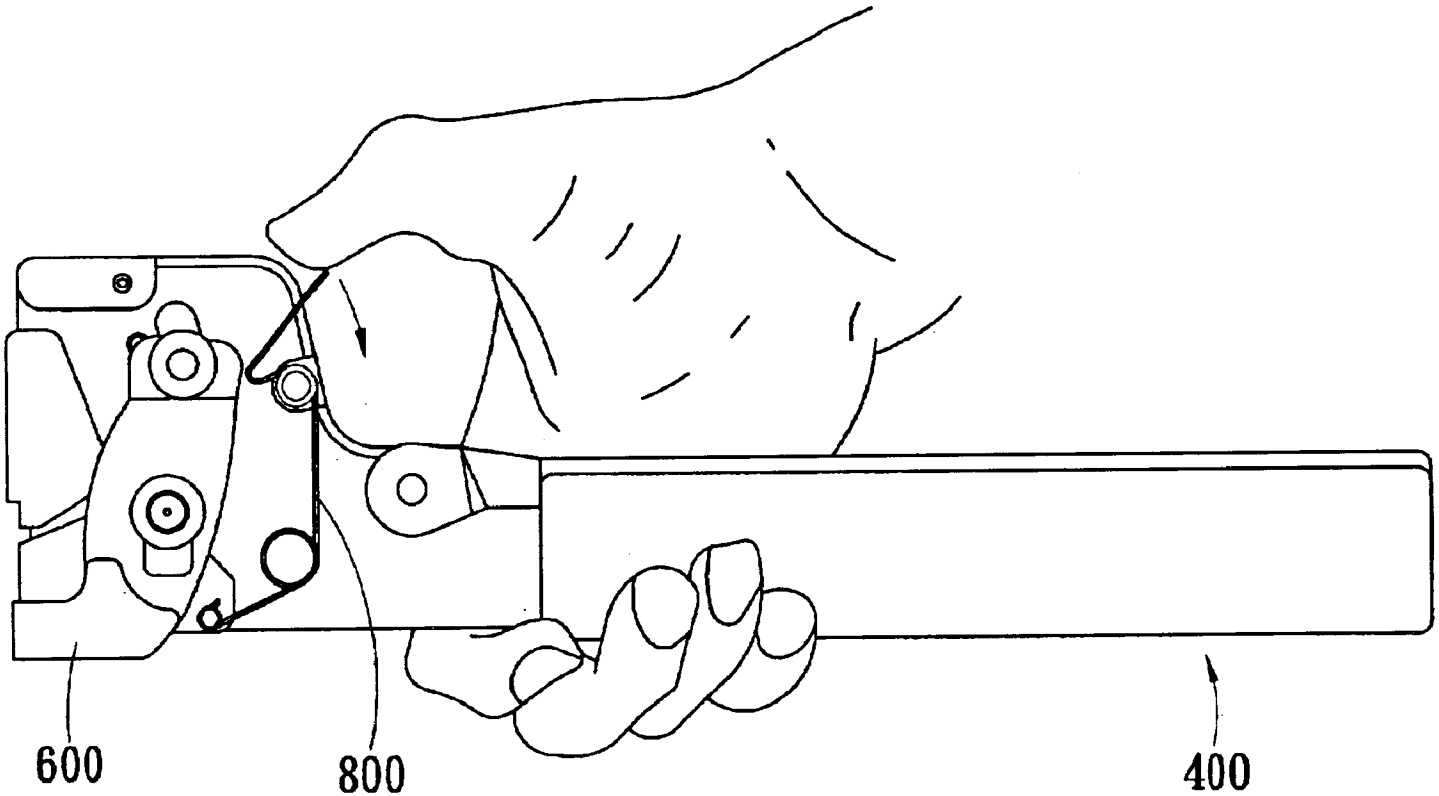
FIG. 6B PRIOR ART
Figure 6D:
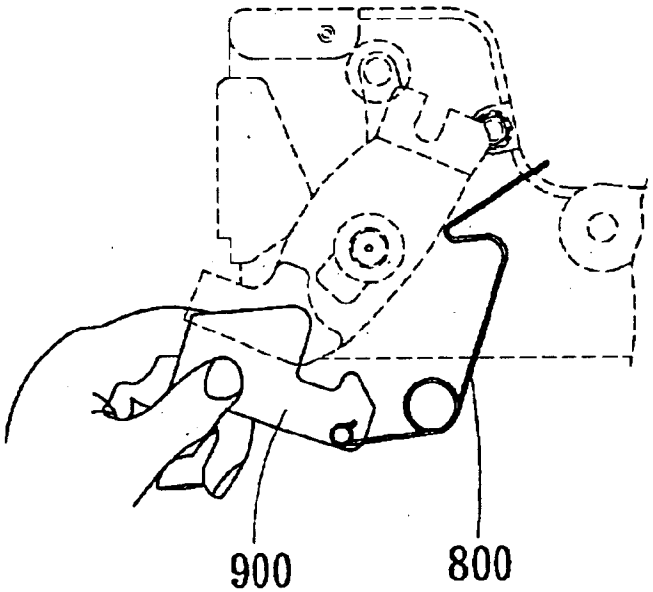
FIG. 6D PRIOR ART
Figure 6C:
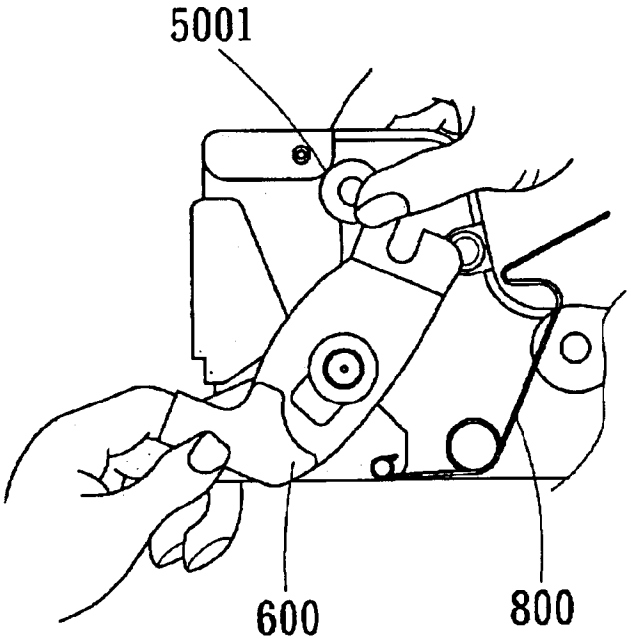
FIG. 6C PRIOR ART
Figure 7:
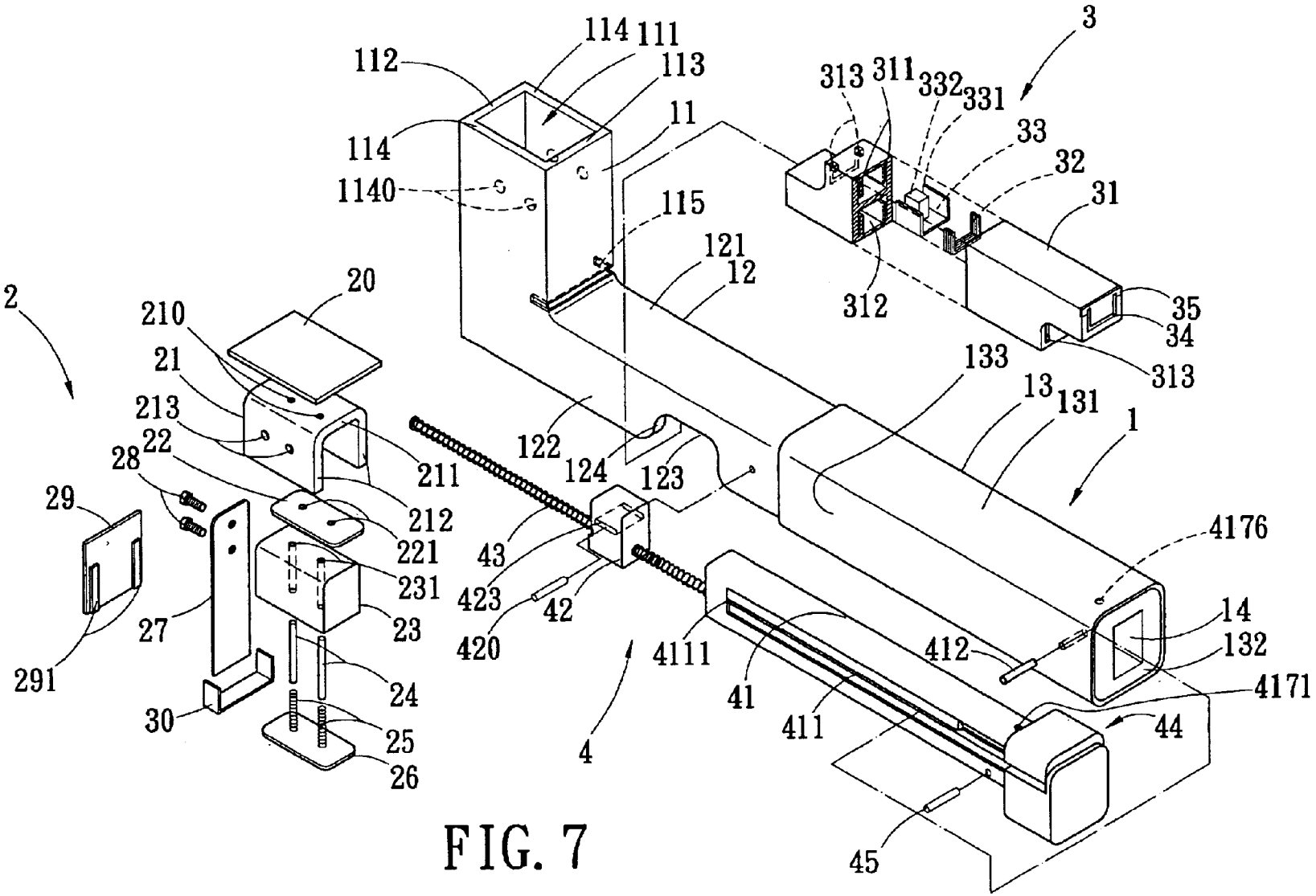
FIG. 7 is an exploded view of a new hammer-type stapler with cartridge, according to the present invention.

With referring now to the drawings, and in particular to FIG. 7, an exploded view of a new hammer-type stapler with cartridge according to the present invention comprises a casing 1, a driving unit 2, a cartridge 3 and a pushing device 4. The casing I is an integral casing having a front portion 12 and handle 13 connected with a distal end of the front portion 12, a hollow hammer casing 11 extended from an opposing end of the front portion 12. A striking unit 2 vertically mounted in the hammer casing 11. The hammer casing 11 has a front wall 112, a back wall 113, two opposing side walls 114 and an upper opening 111. A plurality of protrusion 1140 formed on an inner surface of each opposing side walls 114. The front portion 12 has a top wall 121, two opposing side walls 122 and a lower opening 123. The top wall 121 connects with the back wall 113 of the hammer casing 11 and forms a horizontal shock-shearing groove 115 thereon for reducing the vibration resulted from the working. The side walls 122 of the front portion 12 connects with the side walls 114 of the hammer casing 11 and forms a cartridge-taking opening 124.thereon adjacent to the opening 123 for taking out the cartridge 3 conveniently. The handle 13 could be covered with a coat of soft material for a comfortable hold and for absorbing vibration, and has atop wall 131 a lower wall 132 and two opposing side walls 133. A distal end of the handle 13 formed a distal opening 14 for slidably mounted the pushing device 4 therein. The cartridge 3 was installed into the front portion 12 from the distal opening 14. The pushing device 4 pierces into and props up the cartridge 3, also pushes forward the staples therein. A hammering plate 20 made of metal mounted one the upper opening 111 of the hammer casing 11 increasing the stapler's function as a hammer.

The driving unit 2 includes a weight-containing seat, an U-shaped seat 21, including a top wall 211 and two opposing side walls 211 and formed a concave space, the top wall 211 connected with a bottom of the hammering plate 20 and formed at least one connecting hole, in this embodiment is a pair of connecting holes 210 for connecting at least one weight-guiding device. The weight-guiding device can be a metal plate or a metal casing (not shown), in this embodiment is a pair of weight-guiding rods 24 connected to the connecting holes 210 of U-shaped seat 21; a cushion 22 slidably mounted on the weight-guiding rod 24 with holes 221 and adhered to the top wall 211 of the U-shaped seat 21; a weight 23 slidably mounted on the weight-guiding rods 24 with a pair of through holes 231; an elastic element, in this embodiment is a pair of recoil springs 25 under the weight 23 and slidably-mounted on the weight-guiding rods 24; a bottom plate, in this embodiment is a guiding-rod fixed plate 26 soldered on a distal end of the weight-guiding rods 24; and a driving element 27 screwed onto the weight 23 with screws 28. The recoil springs 25 located between the weight 23 and the guiding-rod fixed plate 26 for providing a recoiling force to the weight 23. The side, walls 212 of the U-shaped seat 21 formed a plurality of concave holes 213 for engaging with the 15 protrusions 1140 of hammer casing 11, thus, the driving unit 2 could be engaged on the hammer casing 11. A bracket 30 adjacent to the driving element 27 has two vertical sideplates respectively formed on two ends of the bracket 30 for connecting to the side walls 114 of the hammer casing 11 and holding the cartridge 3.

The cartridge 3 is composed of two symmetrical, upper and lower staple containers 31, which are opposite in direction, and with respective outstanding portion at opposite ends. The staple containers 31 respectively protrude two parallel tracks 311 from each opposite top surface therein defining an E-shaped groove 312 for allowing staples 32 and a staple pusher 33 to slide on. To prevent the staple pusher 33 from slipping off the staple container 31, a sealer 313 formed on an end of the staple container 31 with a tool, for example, a heated soldering iron. The staple pusher 33 has a staple-like shell 331 and a block 332 protruding from an internal bottom surface of the staple-like shell 331. The block 332 is pushed by the pushing device 4 that pushes the staples 32 forward. Another end of the staple container 31 has a staple-outlet 34, which mounted with a steel pad 35.for protecting the cartridge 3 against cutting and abrasion from the driving element 27. The length of the block 332 and of steel pad 35 coordinated each other so as not to let the staple pusher 33 project out of the staple-outlet 34.

To match up the two ends of the cartridges, a cartridge matching unit, a guiding plate 29 for the driving element 27 is embedded in the internal surface of the front wall 112 of the hammer casing 11 for guiding the driving element 27 to smoothly move up and down.

The pushing device 4 comprises a pushing-device casing 41 mounted with a securing unit 44 on a distal end thereof, a spring pushing unit 43 affixed in the pushing-device casing 41 with a pin 45, and a cartridge holder 42 slidably mounted on the pushing device 4. A horizontal groove 411 is formed on a lateral surface of the pushing-device casing 41 with an end 411, so as not to cross the lateral surface. A pin 412 is inserted into a lateral surface of the handle 13 corresponding to the horizontal groove 411, so that the pushing device 4 can slide in the handle 13 and not apart the casing 1 with the affixed pin 412. The cartridge holder 42 slides in the casing 1 with a pin 420 for supporting the cartridge 3.

Figure 8:
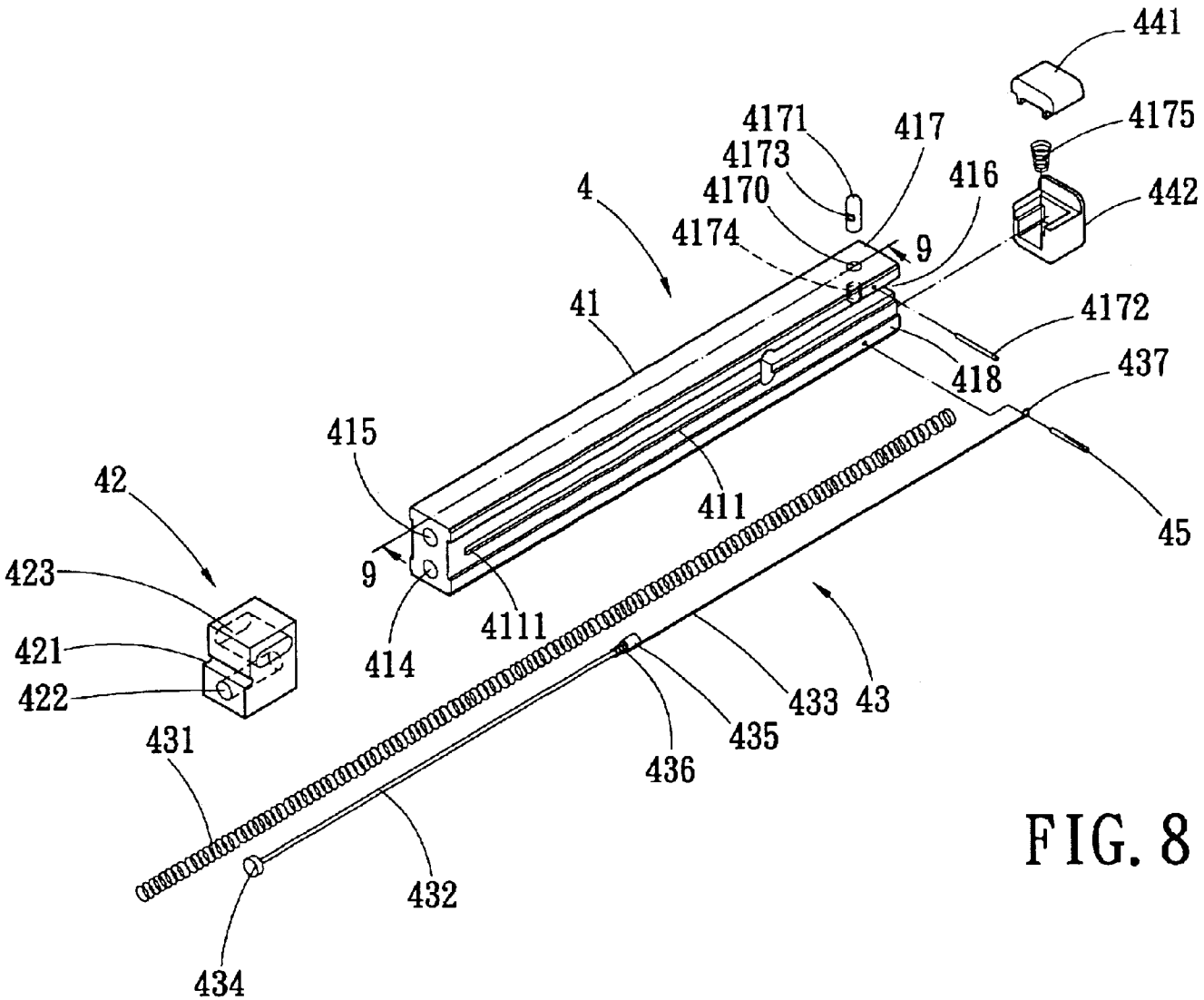
FIG. 8 is an exploded view of the pushing device of the present invention.
Figure 9:
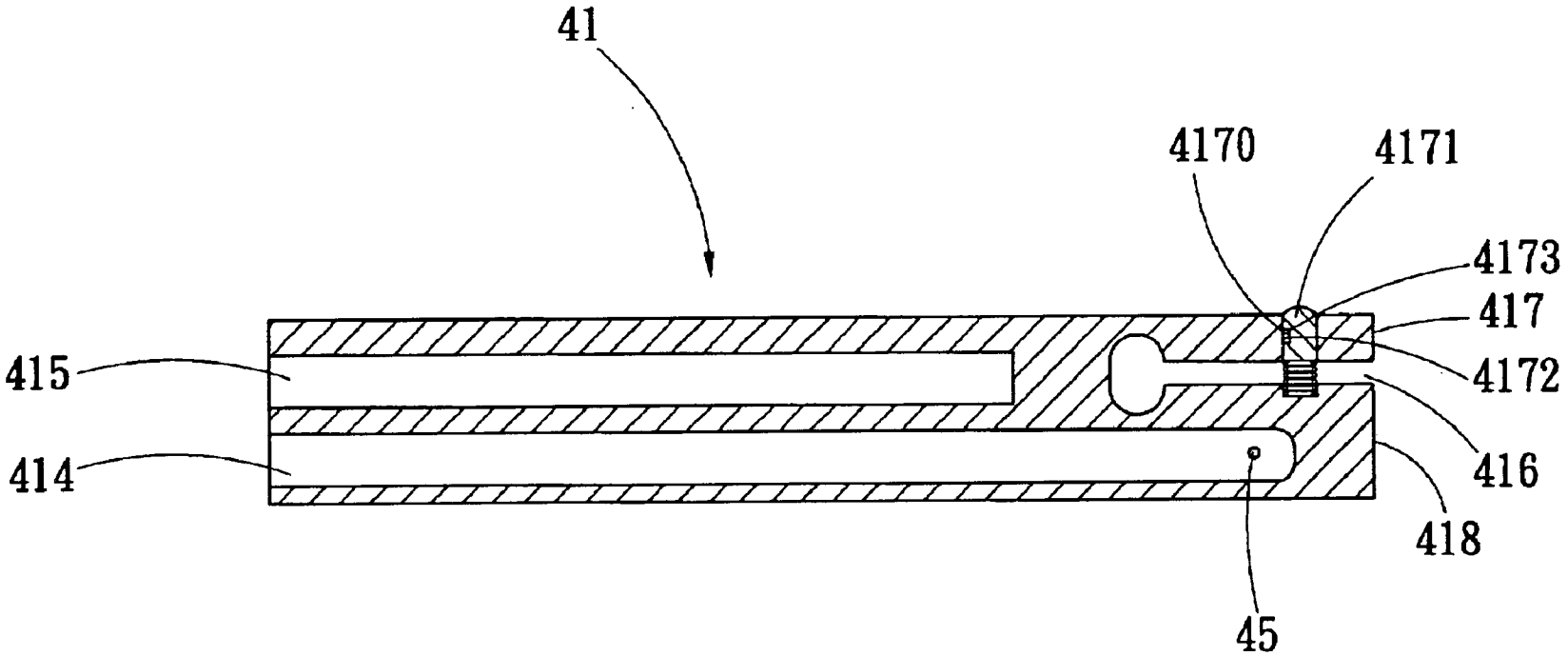
FIG. 9 is a schematic cross-sectional view along line, 9—9 of the present invention.

Referring FIGS. 8 and 9, FIG. 8 is an explode view of the pushing device 4 and FIG. 9 is a cross-sectional view according to line 9—9 in FIG. 8, a sidelong opening 416 formed on a distal end of the pushing-device casing 41 with an upper board 417 and lower board 418. The upper board 417 has a locking hole 4170 in the center inserted with a lock pin 4171, the lock pin 4171 formed a lateral opening 4173 crossed with a pin 4172 which crossed the upper board 417, so that the lock pin 417 affixed in the upper board 417. A spring 4174 is mounted under the lock pin 417 and on the lower board 418. The upper board 417 connects an upper pressing apparatus. 441, the lower board 418 connects a lower pressing apparatus 442, and a spring 4175 mounted between the upper pressing apparatus 441 and lower pressing apparatus 442. A locking hole 4176 formed on the internal surface of the upper wall 131 of the handle 13 corresponding with the lock pin 417, when the pushing:device 4 is pushed to the bottom, the lock pin 417 can be engaged into the locking hole 4176, so that the pushing device 4 can lockon the handler 13. An end of the pushing-device casing 41 opposite the sidelong opening 416 formed a spring chamber 414 for containing the spring pushing unit 43, and an empty groove 415 above the spring chamber 414 for reducing the weight.

The cartridge holder 42 comprises a holding flange 421 extended thereon in horizontal direction, a penetrating hole 422 formed therein to let the spring pushing unit 43 pass through, and a sliding groove 423 crosscutting therein and vertical to the penetrating hole 422 with a pin 420 penetrated into it, so that the cartridge holder 42 can slide within the side walls 122 behind the cartridge-taking opening 124.

The spring pushing unit 43 comprises a spring 431, a front rod 432 and a rear rod 433. The front rod 432 has a pushing end 434 at a distal end for pushing the staple pusher 33 in the cartridge 3, and a wedging block 435 formed at another distal end. The rear rod 433 has a guiding ring 436 in a distal end that is smaller than the wedging block 435 seizing it The front rod 432 slipped in the guiding ring 436, forming an adjustable guiding rod. The rear rod 433 has a locking hole 437 formed at another end, which affixed at a distal end of the spring chamber 414 of the pushing-device casing 41 with a pin 45. The spring 431 has been compressed and mounted between the pushing end 434 and the locking hole 437.

Figure 10:
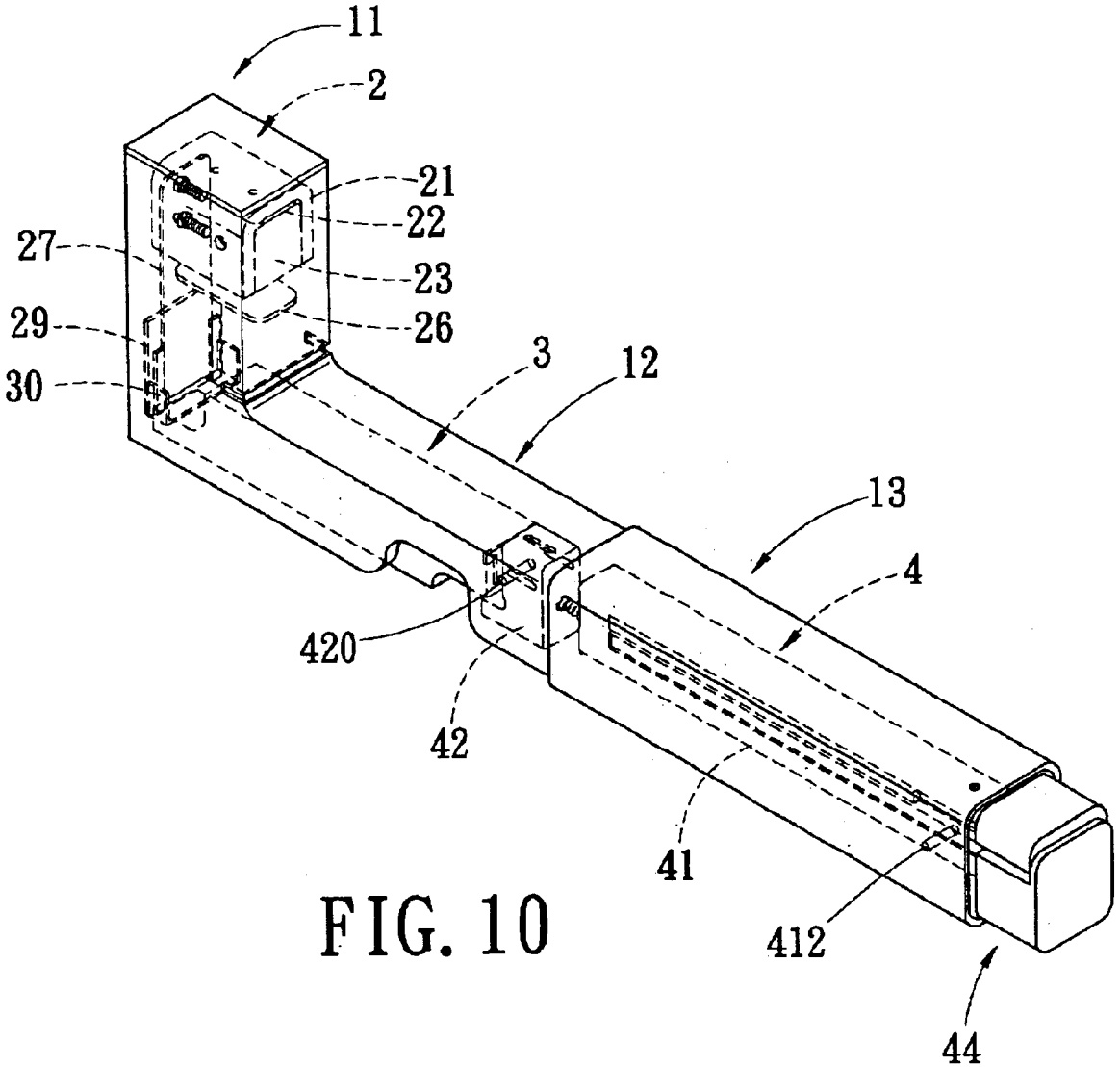
FIG. 10 is an assembled-schematic view of the present invention.

Referring to FIG. 10, it is an assembled schematic view of the present invention. Moreover, we can apply the micro-cellular foam injection molding processing technology to the casing of the present invention. The process uses foaming agent or inert gases, typically nitrogen or carbon dioxide, to create evenly distributed and uniformly-sized microscopic cells throughout a polymer. The gas is injected into the polymer melt and mixed in supercritical condition. The plastics-gas mixture is injected into the injection molding tool, where it forms small, finely distributed gas bubbles such, as cellular structure via the air diffusing action to the plastic material. The functions that can be achieved are as follow:

1. Reduces the weight of the finished products, and intensifies the intensity of structure of each unit volume or weight.
2. The microscopic gas bubbles can absorb the vibration of the stapler while striking, the vibration conveyed to the handle would be reduced much, lessening the tiredness of hand.

Figure 11:
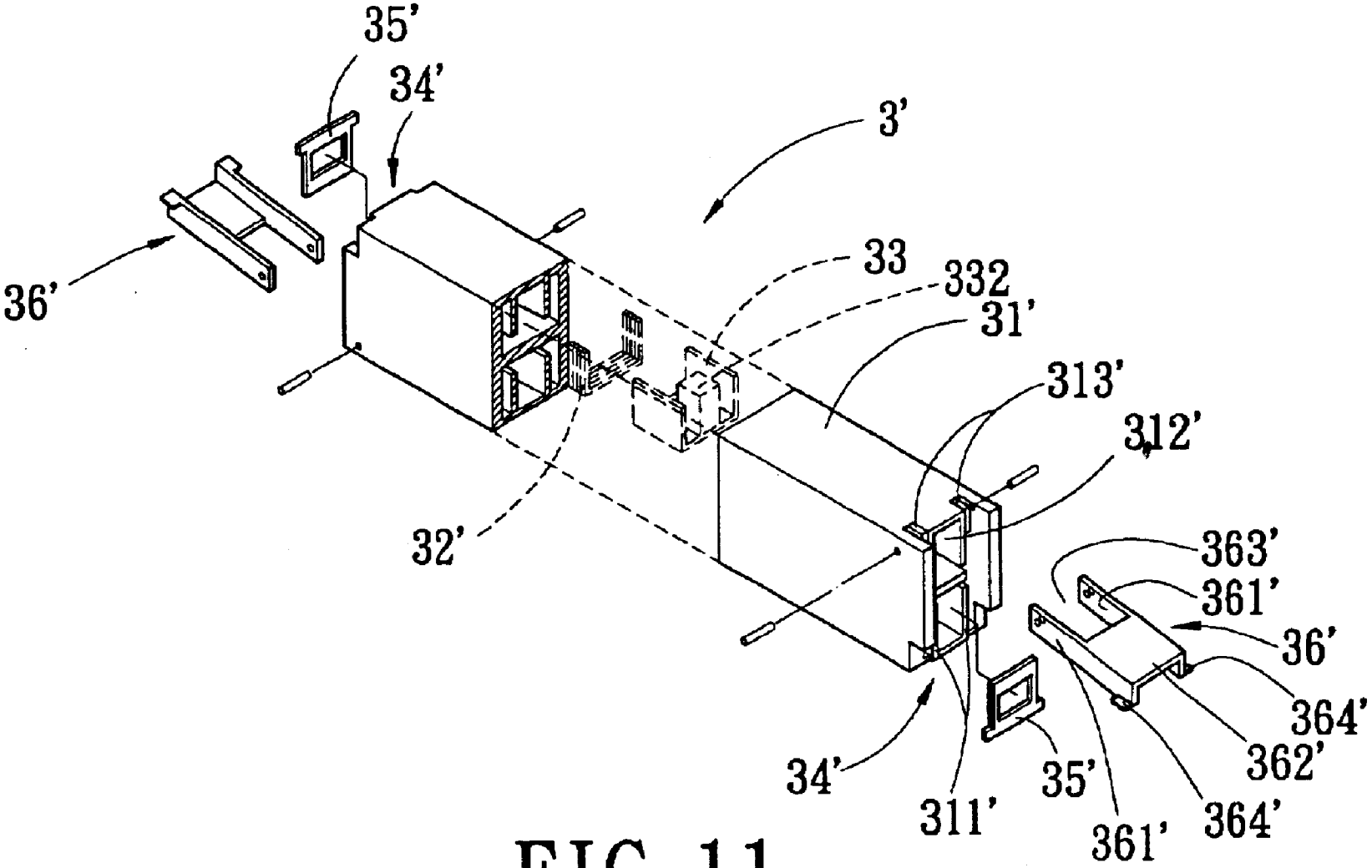
FIG. 11 is an exploded view of the cartridge for various wide staples.

In view of the forgoing disadvantages inherent in the known types of staplers that can only use a specific size of staple, the present invention provides a cartridge for various wide staple, as shown in FIG. 11. The cartridge for various wide staple 3' is composed of two identical, upper and lower staple containers 31', which are opposite in direction up and down, left and right of each other. The staple containers 31' respectively protrude two parallel tracks 311' from each opposite top surface therein defining an E-shaped groove 312' for-allowing staples 32' and the staple pusher 33 to slide on. The staple pusher 33 is the same in two embodiments of cartridge that also has the staple-like shell 331 and the block 332. To prevent the staple pusher 33' from slipping off the staple container 31', a sealer 313' forms on the end of the staple-container 31' with a tool for example, a heated soldering-iron. The block 332 is pushed by the pushing device 4 that pushes the staples 32' forward. Another end of the staple container 31' has a staples-outlet 34' mounted with a steel pad 35' for protecting the cartridge 3' against cutting and abrasion from the driving clement 27. The length of the block 332 and of steel pad 35' coordinated each other so as not to let the staple pusher 33 project out of the staple-outlet 34'. The staples 32' are, loaded into the cartridge 3' from the. staple-outlet 34'. A metal covering 36' pivoted on the upper part of the staple-outlet 34', including two lateral surfaces 361' respectively bended from the two side distal portion of the metal covering 36', a front hood 362' is formed between the two lateral surfaces 361' which is adjacent to the staple-outlet 34', and an upper opening 363' is formed above the front hood 362'; whereby exactly guiding the driving element 27 to drive staples, and prevents staples. 32' from slipping off the staple-outlet 34'. The front hood 362' has two protruding ears 364' respectively formed on the distal end of the lateral surfaces 361', to conveniently open the metal covering 36'. By analyzing all the staple kinds of different factories, those staples differ in about 5 mm in width, by setting the width of the lateral surfaces 361' adapted to different staples, the cartridge for various wide staple 3' can accommodate staples of different width. Hence, the new hammer-type stapler can load different staples by using different cartridge 3'.

Figure 12:
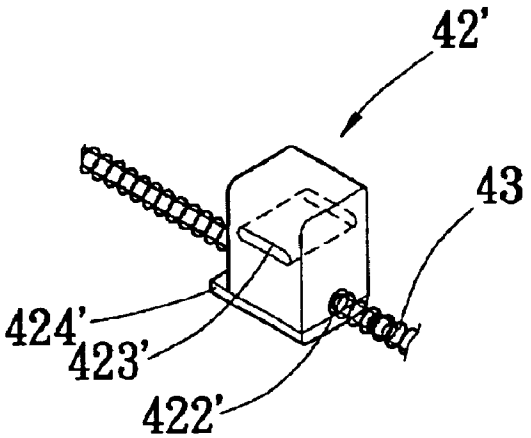
FIG. 12 is a perspective view of the stapler holder of the second embodiment of the present invention.

Referring to FIG. 12, is another embodiment of the cartridge holder 42' according to the cartridge for various wide staple 3'. The cartridge holder 42' has a holding flange, it could be a metal plate 424', extended in the horizontal direction and affixed on the bottom surface thereof for holding the cartridge 3', a penetrating hole 422' formed therein to: let the spring pushing unit 43 pass through, and a sliding groove. 423' crosscutting therein and vertical to the penetrating hole 422' with a pin 420 penetrated into it, so that the cartridge holder 42' can slide within the side walls 122 behind the cartridge-taking opening 124.

Figure 13:
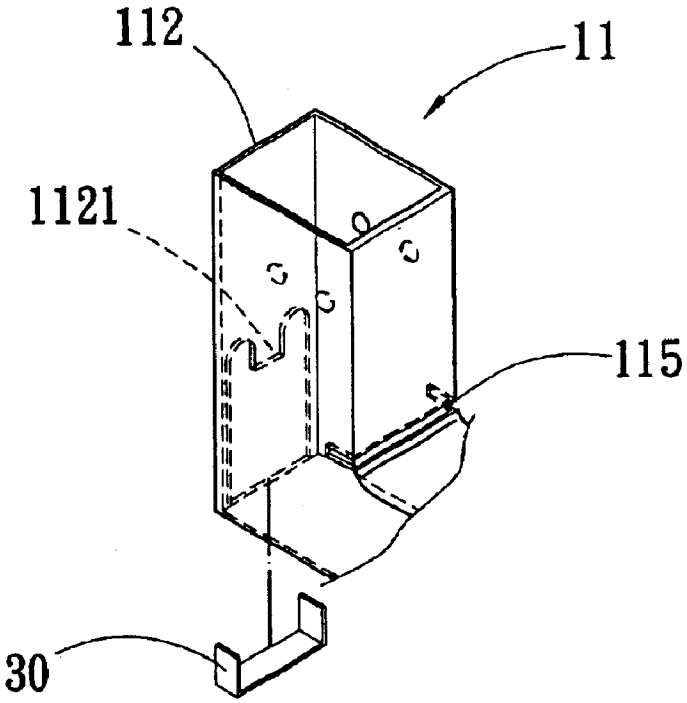
FIG. 13 is a perspective view of the vertical wall of the hammer casing of the second embodiment of the present invention.

Referring to FIG. 13, a cartridge matching unit corresponding to the front portion of the cartridge for various wide staple 3', a concave 1121 is formed on the internal surface of the front wall 112 of the hammer casing 11. The concave 1121 is approximately U-shaped and the depth thereof is about the thickness of the metal covering 36', so that it can match the metal covering 36' and guide the driving element 27 to slide forward along the front wall 112 and into the metal covering 36'.

Figure 14C:
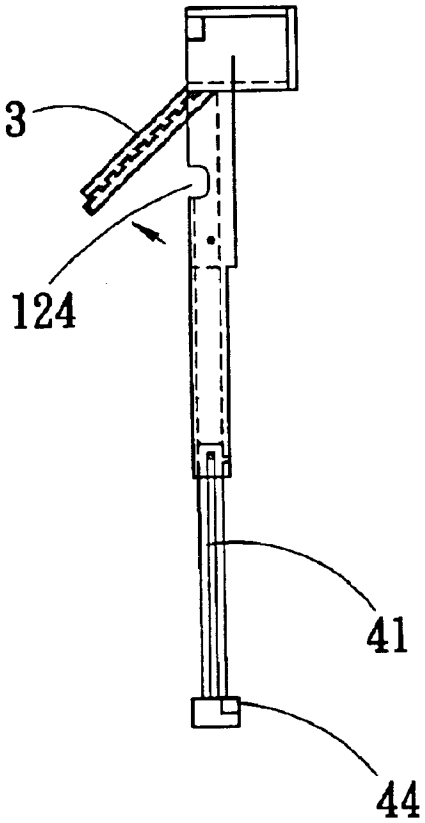
FIG. 14A to 14G is a schematic view of replacing the cartridge of the present: invention.
Figure 14B:
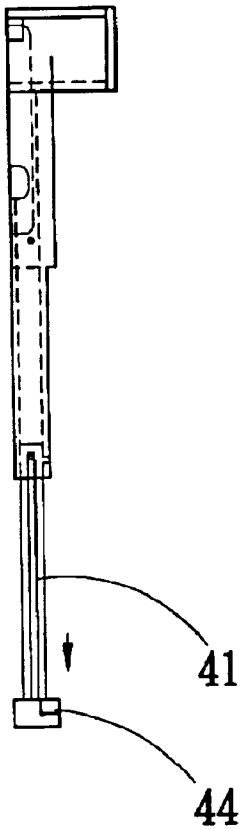
Figure 14A:
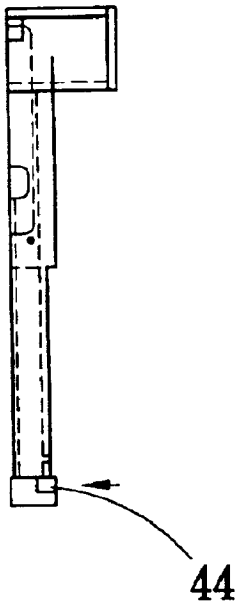
Figure 14G:
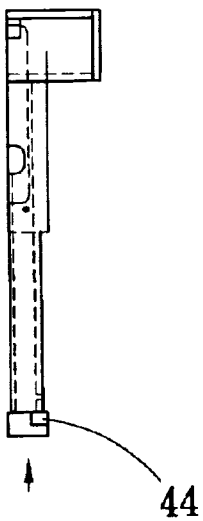
Figure 14F:
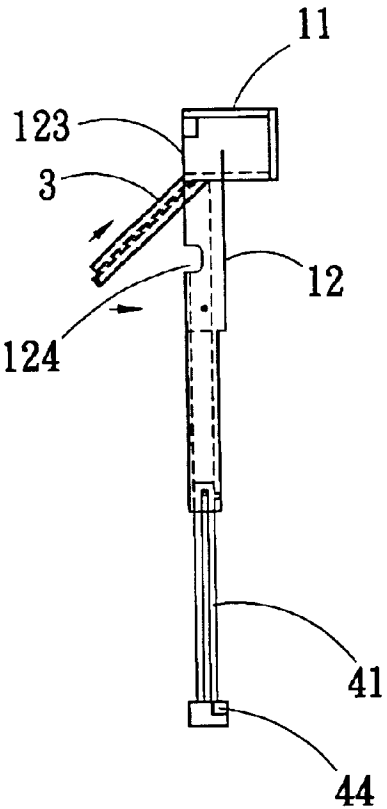
Figure 14E:
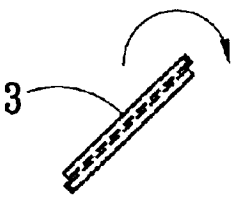
Figure 14D:
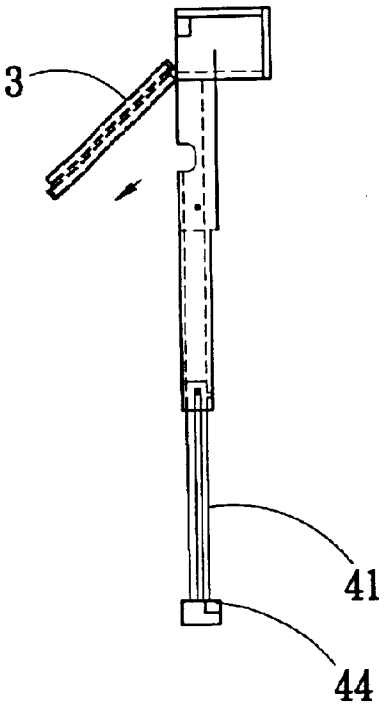

Referring to FIGS. 14A to 14G, showing how to replace the cartridge of the present invention. Press the securing unit 44, as shown in FIG. 14A. Pull out the pushing-device casing 41, as shown in FIG. 14B. Pull the cartridge from the cartridge-taking opening 124, as shown in FIG. 14C. Drag out the cartridge downward, as shown in FIG. 14D. If during a drive stroke, a staple got jammed, it can be removed at this time. Rotate the cartridge in reverse, as shown in FIG. 14E. Through the lower opening 123 of the casing 1, plug the cartridge obliquely into the hammer casing 11, and push it into the front portion 12 from the cartridge taking opening 124, as shown in FIG. 14F. Push the pushing-device casing 41 into the handle 13 until it is locked with the handle, it as shown in FIG. 14G.

The sum up of the characters and advantages are as follow:

1. The present invention, provides a device, which can drive staples vertically to guide the striking force on the staples efficiently without other non-vertical force for reducing the opportunity of jam.
2. The mass of material used in the present invention is plastic, and simplifies the steps of manufacturing to enable the assembly line to be fast and to drop the cost of manufacturing. Moreover, it is a closed module that will not be deposited with sand, prolonging its useful life.
3. The present invention provides the cartridge for various wide staples, which could load various wide staples, so that can use the same stapler can be used to load various wide staples replaceable cartridges. The practicality is advanced.
4. The present invention provides one more function as a hammer with a mounted metal hammering plate on top of the hammer casing, it doesn't need to carry another hammer tool for dealing with the staples which have been driven improperly.

Those skilled in the art will readily observe that numerous modification and alterations of the device can be made while retaining the teachings of the invention. Accordingly, the above disclosure should be construed as limited only by the metes and bounds of the appended claims.

What is claimed is:

1. A hammer-type stapler with cartridge for driving staples into target piece comprising a casing having a front portion and a handle connected with a distal end of said front portion;

a replaceable cartridge installed in said front portion;

a pushing device slidably mounted in said handle;

a hollow hammer casing extended from an opposing end of said front portion, said hammer casing including a front wall, a back wall, a pair of opposite side walls and an upper opening, said upper opening;

a driving unit embedded on said side walls of said hammer casing;

said front portion including a top wall, a pair of opposite side walls and a lower opening, said lower opening extended to said front wall of said hammer casing, said top wall of said front portion connected with said back wall of said hammer casing, said side walls of said front portion connected with said side walls of said hammer casing and respectively formed a cartridge-taking opening thereon adjacent to said lower opening;

a cartridge matching unit installed on an internal surface of said front wall of said hammer casing for guiding said driving unit moved smoothly up and down; and a bracket with two ends respectively affixed on said side walls of said hammer casing adjacent to said cartridge matching unit for holding the cartridge; wherein said handle including a top wall, a lower wall and a pair of opposite side walls with a distal opening formed on an end thereof, said top wall formed a locking hole thereon adjacent to said distal opening, a lock pin installed in said pushing device and plugged in said locking hole; and said cartridge composed of two identical, upper and lower, opposite staple containers, said staple containers respectively protruded a pair of parallel tracks from each opposite top surface therein, a staple pusher and said staples slidably installed on said tracks and pushed by the pushing device, two staple-outlets respectively formed on said staple containers , and two steel pads respectively mounted on said staple-outlets for protecting said cartridge against cutting and abrasion from the driving element.

2. A hammer-type stapler with cartridge for driving staples into target piece as claimed in claim 1, wherein a shock-shearing groove is formed in the a connected portion of said top wall of said front portion and said back wall of said hammer casing.

3. A hammer-type stapler with cartridge for driving staples into target piece as claimed in claim 1, wherein a coat of soft material is covered on said handle for a comfortable hold and for absorbing vibration.

4. A hammer-type stapler with cartridge for driving staples into target piece as claimed in claim 1, wherein said driving unit includes:

an U-shaped seat with a concave space therein including a top wall and two opposing side walls, a weight-guiding device mounted in said concave space and connected to said top wall, a weight slidably mounted on said weight-guiding device, a cushion installed between said weight-guiding device and said U-shaped seat for reducing an impacted force from said weight bounced, a bottom plate connected to a distal end of said weight-guiding device, an elastic element installed between said weight and said bottom plate and mounted on said weight-guiding device for providing a recoiling force to said weight, and a driving clement affixed on said weight, and an engaging means formed respectively on said side walls of said U-shaped seat and said side walls of said hammer casing; whereby said driving unit can be engaged on the hammer casing and said driving element adjacent to said front wall of said hammer casing for driving said staples into target piece.

5. A hammer-type stapler with cartridge for driving staples into target piece as claimed in claim 1, wherein said pushing device includes:

a pushing-device casing, a spring pushing unit affixed in said pushing-device casing, and a cartridge holder slidably mounted on said spring pushing unit;

said pushing-device casing having a sidelong opening formed on a distal end thereof defining an upper board and a lower board, said upper board having an upper pressing apparatus at a distal end, said lower board having a lower pressing apparatus at a distal end, an elastic element installed between said upper board and said lower board, a spring chamber formed at another end opposite said sidelong opening for containing said spring pushing unit, an empty groove formed above said spring chamber for reducing total weight, a horizontal groove formed on a lateral surface thereof with an terminal end, and a pin plugged into a lateral surface of said handle corresponding to said horizontal groove;

said cartridge holder having a holding flange horizontally extended thereon for matching two ends of said cartridge and holding said cartridge in said casing, a penetrating hole formed therein to let said spring pushing unit passed through, and a sliding groove crosscutting therein and vertical to said penetrating hole with a pin penetrated therein; whereby the cartridge holder can slide within the side walls behind the cartridge-taking opening;

said spring pushing unit including a spring, a front rod, and a rear rod slipped on said front rod and formed an adjustable guiding rod, said guiding rod pushing said staple pusher with an end thereof and the other end affixed in a bottom of said spring chamber.

6. A hammer-type stapler with cartridge for driving staples into target piece as claimed in claim 1, wherein said staple containers of said cartridge respectively outstand a section toward said staple-outlet, said staple pusher of said cartridge further including a staple-like shell and a block protruded from an internal surface of said staple-like shell, a sealer formed on an end of said staple container for preventing said staple pusher slipped off, and the other end of said staple container forming a staple-outlet; wherein the length of said block match up said steel pad result in said staple pusher will not project said staple-outlet to avoid striking from said driving element.

7. A hammer-type stapler with cartridge for driving staples into target piece as claimed in claim 1, wherein said cartridge matching unit is a guiding plate embedded in an internal surface of said front wall of the hammer casing with two vertical guiding tracks formed thereon for guiding said driving element smoothly moved up and down.

8. A hammer-type stapler with cartridge for driving staples into target piece as claimed in claim 1, wherein a finished polymer of said casing having microscopic gas bubbles throughout therein; whereby reducing the weight of said casing and lessening the tiredness of hand during operating.

9. A hammer-type stapler with cartridge for driving staples into target piece comprising:

a casing having a front portion and a handle connected with a distal end of said front portion;

a hollow hammer casing extended from an opposing end of said front portion;

a driving unit vertically mounted in said hammer casing for driving said staple with a vertical action, said driving unit comprising a weight-containing seat affixed in said hammer casing with at least a weight-guiding device mounted therein, a weight slidably mounted on said weight-guiding device, a bottom plate affixed to a distal end of said weight-guiding device, at least an elastic element installed between said weight and said bottom plate for providing a recoiling force to said weight, and a driving element affixed on said weight, and a driving element affixed on said weight for driving staples into target piece;

a replaceable cartridge installed in said front portion;

a pushing device slidably mounted in said handle for pushing said staples in said cartridge to a driven position under said driving unit; and a metal hammering plate mounted on a top of the hammer casing whereby said hammer-type stapler with a function of being a hammer.

10. A hammer-type stapler with cartridge for driving staples into target piece as claimed in claim 9, wherein a connected portion between said front portion and said hammer casing is formed with a horizontal shock-shearing groove.

11. A hammer-type stapler with cartridge for driving staples into target piece as claimed in claim 9, wherein a coat of soft material is covered on said handle for holding comfortably and absorbing vibration.

12. A hammer-type stapler with cartridge for driving staples into target piece as claimed in claim 9, wherein said weight-guiding device is selected from the group consisting of: a weight-guiding rod, a metal plate, or a metal shell.

13. A hammer-type stapler with cartridge for driving staples into target piece as claimed 9, wherein said driving unit comprises a cushion installed between said weight-guiding device and said weight-containing seat.

14. A hammer-type stapler with cartridge for driving staples into target piece as claimed in claim 9, wherein said hammer casing comprises:

a cartridge matching unit formed thereon for alternatively matching two ends of said cartridge; and a bracket affixed on a lower portion of said hammer casing adjacent to said cartridge matching unit for holding the cartridge.

15. A hammer-type stapler with cartridge for driving staples into target piece as claimed in claim 9, wherein said casing is made of a polymer material and formed with a plurality of microscopic gas bubbles therein; whereby the weight of said casing is minimized.

16. A hammer-type stapler with cartridge for driving staples into target piece comprising:

a casing having a front portion and a handle connected with a distal end of said front portion;

a hollow hammer casing extended from an opposing end of said front portion;

a driving unit vertically mounted in said hammer casing for driving said staple with a vertical action;

a replaceable cartridge installed in said front portion;

a pushing device slidably mounted in said handle for pushing said staples in said cartridge to a driven position under said driving unit; and a metal hammering plate mounted on a top of the hammer casing whereby said hammer-type stapler with a function of being a hammer;

wherein said pushing device comprises:

a pushing-device casing, a spring pushing unit affixed in said pushing-device casing, and a cartridge holder slidably mounted on said spring pushing unit;

said pushing-device casing having a securing unit mounted on an end thereof for locking up therein, said securing unit having at least one elastic element for providing force while unlocking, a spring chamber formed at another end thereof for containing said spring pushing unit, a horizontal groove formed on a lateral surface thereof with an terminal end, and a pin plugged into a lateral surface of said handle corresponding to said horizontal groove;

said cartridge holder having a penetrating hole formed therein, and a sliding groove crosscutting therein vertical to said penetrating hole and matching with a pin penetrated on said casing, and a thin metal plate connected on a bottom thereof and horizontally protruding a proper length;

said spring pushing unit including a spring, a front rod, and a rear rod slipped on said front rod and formed an adjustable guiding rod; wherein an end of said front rod pushing said staple pusher, and an end of said rear rod affixed in a bottom of said spring chamber.

17. A hammer-type stapler with cartridge for driving staples into target piece as claimed in claim 16, wherein said securing unit of said pushing-device casing comprises a sidelong opening formed on a distal end thereof defining an upper board and a lower board, a lock pin slidably mounted in said upper board, an elastic element mounted between said lock pin and said lower board, an upper pressing apparatus connected on a distal end of said upper board, a lower pressing apparatus connected on a distal end of said lower board, an elastic element mounted between said upper board and said lower board, a spring chamber formed at another end opposite said sidelong opening for containing said spring pushing unit, an empty groove formed above said spring chamber for reducing total weight, a horizontal groove formed on a lateral surface thereof with an terminal end, and a pin plugged into a lateral surface of said handle corresponding to said horizontal groove.

* * * * *